US010223872B2

(12) United States Patent
Jackson

(10) Patent No.: US 10,223,872 B2
(45) Date of Patent: Mar. 5, 2019

(54) ENHANCED REPLACEMENT DECK FOR DRAW POKER

(71) Applicant: Kathleen Nylund Jackson, Scituate, MA (US)

(72) Inventor: Kathleen Nylund Jackson, Scituate, MA (US)

(73) Assignee: Precedent Gaming, Inc., Newport, NC (US)

( * ) Notice: Subject to any disclaimer, the term of this patent is extended or adjusted under 35 U.S.C. 154(b) by 60 days.

(21) Appl. No.: 13/998,455

(22) Filed: Nov. 1, 2013

(65) Prior Publication Data

US 2014/0370954 A1 Dec. 18, 2014

Related U.S. Application Data

(60) Provisional application No. 61/956,633, filed on Jun. 13, 2013.

(51) Int. Cl.
*G07F 17/32* (2006.01)
*A63F 3/00* (2006.01)

(52) U.S. Cl.
CPC ..... *G07F 17/3293* (2013.01); *A63F 3/00157* (2013.01); *G07F 17/326* (2013.01); *G07F 17/3262* (2013.01); *G07F 17/3209* (2013.01)

(58) Field of Classification Search
CPC ..... G07F 17/3293; G07F 17/3244; G07F 17/3209; G07F 17/326; G07F 17/3262; A63F 3/00157; A63F 1/00; A63F 2001/003; A63F 2001/005
See application file for complete search history.

(56) References Cited

U.S. PATENT DOCUMENTS

| | | | | |
|---|---|---|---|---|
| 5,019,973 | A | 5/1991 | Wilcox | |
| 5,042,818 | A * | 8/1991 | Weingardt | 463/13 |
| 5,823,873 | A | 10/1998 | Moody | |
| 6,602,134 | B2 | 8/2003 | Wood | |
| 7,056,206 | B2 | 6/2006 | Aoki | |
| 7,056,207 | B2 | 6/2006 | Walker | |
| 7,416,186 | B2 | 8/2008 | Walker | |
| 7,470,183 | B2 | 12/2008 | Wishart | |
| 7,740,533 | B2 | 6/2010 | Walker | |
| 7,749,061 | B2 | 7/2010 | Walker | |
| 7,758,410 | B2 | 7/2010 | Hughes | |
| 7,867,073 | B2 | 1/2011 | Walker | |
| 7,922,571 | B2 | 4/2011 | Walker | |
| 7,926,813 | B2 | 4/2011 | Moody | |

(Continued)

*Primary Examiner* — Justin L Myhr

(57) ABSTRACT

A method of playing a five-card draw video poker wagering game on a gaming device comprising at least a processor, input device and video monitor screen is disclosed. A special function provides the player with an opportunity to enhance the replacement deck with additional cards. The special function provides the player with a touchscreen display of individual symbols that are displayed as two sets: the thirteen ranks and the four suits. Each individual symbol has its own touchscreen button. The player or processor selects one symbol. Any or all of the cards in the replacement deck that match the selected rank or suit are then replicated and added to the replacement deck. Cards are randomly selected from the enhanced replacement deck, and populate the initial hand to complete the final hand. Any wins are paid according to a predetermined paytable.

16 Claims, 18 Drawing Sheets

(56) References Cited

U.S. PATENT DOCUMENTS

| | | | | |
|---|---|---|---|---|
| 7,993,191 | B2 | 8/2011 | Evans | |
| 8,016,656 | B2 | 9/2011 | Berman | |
| 8,210,532 | B2 | 7/2012 | Evans | |
| 8,210,533 | B2 | 7/2012 | Evans | |
| 8,308,538 | B2 | 11/2012 | Naicker | |
| 8,342,933 | B2 | 1/2013 | Berman | |
| 2002/0145255 | A1* | 10/2002 | Rudolph | 273/292 |
| 2004/0212147 | A1 | 10/2004 | Ward | |
| 2006/0214375 | A1* | 9/2006 | Wonpu | 273/292 |
| 2007/0032284 | A1 | 2/2007 | Englman | |
| 2007/0077976 | A1 | 4/2007 | Jackson | |
| 2008/0064462 | A1 | 3/2008 | Gerrard | |
| 2009/0005145 | A1 | 1/2009 | White | |
| 2009/0318215 | A1* | 12/2009 | Acres | 463/20 |
| 2011/0312399 | A1 | 12/2011 | Vancura | |
| 2013/0116026 | A1 | 5/2013 | Berman | |
| 2014/0221070 | A1* | 8/2014 | Lund | 463/13 |

* cited by examiner

ENHANCED REPLACEMENT DECK FOR DRAW POKER

RELATED APPLICATION DATA

This application claims priority from U.S. Provisional Patent Application Ser. No. 61/956,633, filed Jun. 13, 2013, and having the Title ENHANCED REPLACEMENT DECK FOR DRAW POKER.

BACKGROUND OF THE INVENTION

1. Field of the Invention

The present invention relates to a poker game suitable for use in casinos and other gaming establishments, as well as wagering or non-wagering space including websites and applications, as a video poker game. The invention further relates to casino gaming wherein a draw poker game is played upon an apparatus including a processor, input device and monitor and may provide a greater probability of winning by enhancing the replacement deck with additional cards.

2. Background of the Art

Games based upon variations of poker have attained enormous popularity as casino-type entertainment games, particularly in the last twenty years. The success of poker games in the gaming industry is partially based on the game's simplicity (i.e., there is widespread public knowledge of the game rules) and the fact that players feel more directly involved in exercising judgment in the play of the game.

Traditional poker as played in card rooms, casinos, and wagering or non-wagering websites allows players to compete head to head against other players. The advent of video technology has also allowed poker games to be played not against other players but against a paytable that determines wins and losses. These games are described as "video poker".

Video poker was first conceived as a "Jacks-or-Better" draw poker game; that is, the player must achieve at least a pair of jacks in order to win. Traditionally, the highest paying Jacks-or-Better hand is a royal flush, and all 4-of-a-kinds or "quads" (that is, four 2s through four Aces) each pay the same premium award. Since Jacks-or-Better gameplay is non-volatile (that is, there are few large swings between winning and losing hands), many new and more volatile approaches to video poker have been developed for gaming machines. These poker versions include Bonus Poker, Double Bonus Poker, Double Double Bonus Poker and Triple Double Bonus Poker. In comparison to Jacks-or-Better gameplay, in each of these versions the awards for achieving certain final hands containing 4-of-a-kind are enhanced, while the awards for lower-paying final hands such as a full house or 3-of-a-kind are diminished. These versions have become very popular since the awards for 4-of-a-kind can be very significant; in fact, in Triple Double Bonus Poker, achieving four Aces with the fifth card being a 2, 3 or 4 pays the same as achieving a royal flush.

Typically, a hand of 5-card draw poker is dealt from a standard deck of 52 cards. The player chooses to hold none, one, some or all of the dealt cards. Any non-held cards are discarded, and replacement cards from the remaining deck of 47 cards are provided. The final hand is evaluated for any winning combinations, and paid according to a predetermined paytable.

In more recent years, new video poker variations have been invented in addition to the above described various poker versions, including bonus games, wild card games and multiplier games. These variations have added additional excitement, anticipation and volatility to video poker, thereby increasing player participation. This is important to any gaming establishment. Since in virtually every gambling game there is a house advantage (that is, the casino will hold a percentage of the bet, and the player will play the game at less than a 100% payout), it is advantageous for the casino to draw in players to the machine and keep them playing.

Certain attempts have been made to create new video poker games in order to stimulate player participation. In particular, the following prior art refers to certain cards being added or subtracted during the play of the basic draw poker game, or different replacement card rules being applied.

U.S. Pat. Nos. 8,342,933 and 8,016,656 (Berman, et al.) describes a video poker game in which a player is allowed to hold cards (or other items) of a starting hand/payline. Multiple sets of potential replacement cards are provided, from which the player can select the desired set of replacement cards. The selected set of replacement cards is used to complete the player's hand.

U.S. Pat. No. 8,308,538 (Naicker) teaches a poker game that is presented with opportunities to replace one or more of the cards in his or her hand. The first such replacement may be free, but the player may incur a cost for each subsequent replacement. This cost may be based on how much the player is expected to benefit from the replacement.

U.S. Pat. Nos. 8,210,533, 8,210,532 and U.S. Pat. No. 7,993,191 (Evans, et al.) describe a gaming system having a five-card draw poker game. An initial five-card hand is dealt and a first draw card is revealed. The player may keep or discard the first draw card. After the player decides whether to keep or discard the first draw card, the player may replace cards in the initial hand. If the player selects to discard the first draw card, this card is not used as a replacement card to form a final hand. In certain implementations, the player first selects cards in the initial hand to replace. If the player elects to keep the first draw card, the gaming system displays a second draw card and the player may keep or discard the second draw card. This process continues until all discarded cards in the initial hand have been replaced or the player elects to discard one of the draw cards.

U.S. Pat. No. 7,926,813 (Moody) discloses a poker game in which an extra card is added to the original deck (preferably an extra Ace of all suits) in order to more easily achieve 4-of-a-kind Aces or 5-of-a-kind Aces.

U.S. Pat. No. 7,470,183 (Wishart) provides data indicative of a final outcome that may be received, and an initial set of symbols indicative of the final outcome may be displayed if the data indicative of the final outcome indicates a winning outcome, the initial set of symbols including an initial winning subset of symbols and an initial non-winning subset of symbols. Player input data indicative of a subset of symbols in the initial set to be discarded may be received, and replacement symbols may be determined such that a final set of symbols is indicative of the final outcome if the subset of symbols to be discarded includes at least one symbol from the initial winning subset, wherein the final set of symbols includes the replacement symbols in place of the subset of symbols to be discarded.

U.S. Pat. No. 7,056,206 (Aoki, et al.) discloses a video poker game in which a plurality of face-up cards are dealt from a deck into a card hand. If any of the face-up cards is a predefined special card, the game proceeds with a special feature that allows the player to draw a replacement card to replace the special card. The replacement card may be drawn from a plurality of possible face-up or face-down cards. The game may include a standard draw option that allows a player to select and replace none or more of the face-up cards. The special card may trigger the special feature at any time, whether it appears before or after the draw.

U.S. Pat. No. 6,602,134 (Wood, et al.) teaches a card game in which the player makes a wager, preferably a five credit wager, and the player is then dealt an initial five card hand. The player may then stand on his initial five cards or the player may discard unwanted cards and receive a replacement cards for each card that is discarded. In order to discard unwanted cards, the player must make an additional wager, preferably in the amount of one additional credit, for each card that the player wishes to discard.

U.S. Pat. No. 5,823,873 (Moody) describes a video poker game in which the player first plays a five-card draw poker hand. The player selects which of the five cards he wishes to discard and replacement cards for the discarded cards come from a stud poker hand.

U.S. Pat. No. 5,019,973 (Wilcox) discloses a method of conducting a draw poker game wherein the player is provided an option to purchase an additional draw card from the deck for an additional wager.

United States Patent Application No. 20110312399 (Vancura) teaches a poker game in which a player is dealt a first set of cards, such as 5 cards. The player elects which cards to hold and which cards to discard, if any. Upon discarding any cards, a player is dealt a second set of cards, preferably in the same number as the first set of cards. Subsets of the second set of replacement cards are combined with the cards held from the first set of cards to form final hands of cards.

United States Patent Application No. 20080064462 (Gerrard, et al.) discloses a poker game with multiple options for the player to purchase extra cards. In one embodiment a stud five-card hand is dealt to the player. The player can keep the five cards or purchase an extra card at a first cost. If the player purchases the first card, the player can thereafter keep the six-card hand or purchase a second card at a second higher cost. This cycle is repeated for up to a predetermined number of cards such as five additional cards in one embodiment. When five additional cards are purchased, the game provides any accrued award to the player.

United States Patent Application No. 20070077976 (Jackson) teaches a video poker game in which a number of cards are dealt face-up to form an initial hand. The player may select to hold none, one, some or all of the dealt cards. The player then may choose none or at least one of the unheld cards to receive a narrowed selection of possible replacement cards. The narrowing of the number of possible replacement cards will most likely increase the odds of receiving a replacement card that will ultimately enhance the initial deal.

United States Patent Application No. 20070032284 (Englman) describes a wagering game on a gaming machine that includes the steps of receiving an initial wager from a player and dealing a set of initial game elements. The player is provided with an option to purchase an additional game element. In response to player input, none or more of the initial game elements are replaced with respective replacement game elements and, if the player exercised the option, the method also includes dealing the additional game element to form a set of final game elements.

United States Patent Application No. 20040212147 (Ward et al.) discusses a poker type game in which cards numbering less than those in a standard deck of card are used to form a field of cards and a set of dealt cards. The cards of the field of cards are displayed face down. The set of dealt cards are displayed face-up. The combination of the cards in the field of cards and set of dealt cards includes at least one Royal Flush combination. The player discards cards from the set of dealt cards and selects replacement cards to the discarded cards from the field of cards. The player's hand is formed from the set of dealt cards, less any discarded cards, plus the replacement cards.

Each of the references discussed in this text art are incorporated herein in their entirety for all purposes.

It is an ever-increasing challenge to provide players with new and enticing gameplay features that will stimulate player interest and increase time at the machine. It would be advantageous to provide the replacement deck in a standard draw poker game with certain additional cards so that the player may have a greater probability of achieving a winning final hand.

SUMMARY OF THE INVENTION

A method of playing a wagering card game on a gaming device comprising at least a processor, input device and video monitor screen is disclosed. After a primary wager that is recognized by the processor is made, a hand of 5-card draw poker is dealt from a standard deck of 52 cards. The player chooses to hold none, one, some or all of the dealt cards. Any non-held cards are discarded, and replacement cards from the remaining deck of 47 cards (52 minus the 5 dealt cards) are provided for the discards. The final hand is evaluated for any winning combinations, and paid according to a predetermined paytable. If the player has preferably made an additional wager (along with the primary wager), the player may randomly be awarded a special function in the course of the play of the hand.

Specifically, the special function provides the player with an opportunity to enhance the 47-card replacement deck with additional cards. After making at least one wager that is recognized by the processor, and after the player has been dealt the initial hand, the player chooses to hold none, one, some, or all of the dealt cards. Non-held cards are discarded. If the special function, herein called "Stack the Deck Feature", has become activated, the player is then provided with a touchscreen display of specific symbols. The said specific symbols are preferably displayed as two sets: the thirteen ranks (2, 3, 4, 5, 6, 7, 8, 9, 10, J, Q, K, A) and the four suits (Hearts, Diamonds, Spades, Clubs). Each individual symbol has its own touchscreen button.

The player or processor then selects one symbol. Any or all of the cards in the replacement deck that match the selected rank or suit are then replicated and added to the replacement deck. The player then presses Draw to receive the replacement cards. Cards are randomly selected from the enhanced replacement deck, and populate the initial hand to complete the final hand. The final hand is analyzed for wins, and any wins are paid according to a predetermined paytable.

DETAILED DESCRIPTION OF THE INVENTION

Figure 1:
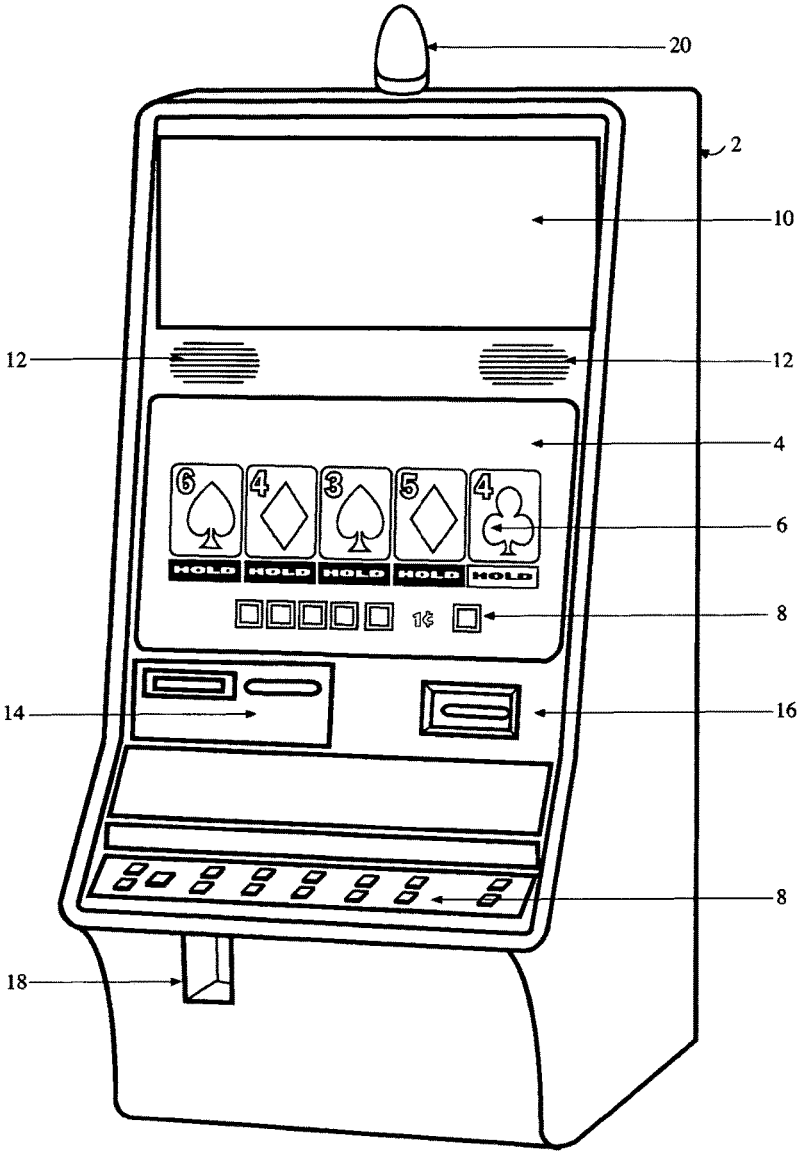
FIG. 1 shows a first gaming device capable of executing the present invention.

A method of playing an electronic card game uses one deck of 52 standard playing cards having thirteen ranks (2, 3, 4, 5, 6, 7, 8, 9, 10, J, Q, K, A) and four suits (Hearts, Diamonds, Spades, Clubs). Alternately the deck may contain additional cards such as Jokers or Wild Cards, in which case the amount of ranks and/or suits may be increased. The game is played utilizing at least a computer processor, input device and a video monitor screen. The game may be played at least on a casino gaming machine, a personal computer or pad, an internet gaming site, or as a mobile application.

The card game is basically a 5-card draw poker game, modified to include a gameplay element that provides an extra excitement and anticipation not seen in traditional draw poker. Alternately, the card game may be a 3-, 4-, 6-, or 7-card game. The game begins with the processor recognizing a primary wager of cash, credits or non-monetary points in order to play the game. After the primary wager is made, a hand of 5-card draw poker is dealt from a standard deck of 52 cards. The player chooses to hold none, one, some or all of the dealt cards. Any non-held cards are discarded, and replacement cards from the remaining deck of 47 cards are provided. The final hand is evaluated for any winning combinations, and paid according to a predetermined paytable.

If the player has preferably made an additional wager (along with the primary wager), a special function is enabled. Alternately, an additional wager may not be required. The special function may become randomly activated in the course of play of the hand. Alternately also, the special function may be provided not randomly, but on every X amount of games or on every wagered game. In addition, the amount of the extra wager required to play the game may determine the random frequency that provides the special function. The special function may become activated before, during, or after the initial hand is dealt, or after the player has chosen any hold cards.

Alternately, the special function may be triggered by a specific predetermined event occurring with the dealt hand. For instance, if at least any three Spades are displayed in the dealt hand, the special function would be activated. It should be appreciated that any other trigger could also be utilized according to the particular game design and mathematical analysis.

In a first embodiment of the present invention, the special function provides the player with an opportunity to enhance a 47-card replacement deck with additional cards. The special function becomes enabled based on the amount of the wager. (It should be noted that the original deck may contain more or less then 52 cards. For instance, in a Jokers Wild game, the original deck would contain 53 cards and the replacement deck would contain 48 cards). After making at least one wager that is recognized by the processor, and after the player has been dealt an initial 5-card hand, the player chooses to hold none, one, some, or all of the dealt cards. Non-held cards are then discarded. If the special function, herein called "Stack the Deck Feature", has become activated, the player is then provided with a touchscreen display of specific symbols. The said specific symbols are preferably displayed as two symbol sets: the thirteen ranks (2, 3, 4, 5, 6, 7, 8, 9, 10, J, Q, K, A) and the four suits (Hearts, Diamonds, Spades, Clubs). (It should be noted that in an original deck containing more than 52 cards, additional symbols may be displayed. For instance, in a Joker Wild game, a Joker symbol would be added to the rank symbol set.) Each individual symbol has its own touchscreen button. It should be appreciated that physical buttons, keyboard buttons, a mouse or any other like tool may instead be utilized in order to enable the player make his choice.

The player may decide to accept the feature or decline. In an alternate option, the machine processor may select the symbol randomly or according to the optimum expected value, and the player may or may not be able to change the processor selection. If the player chooses to accept the feature, he is instructed on the screen display to select one symbol. Any or all cards in the replacement deck that match the selected rank or suit are then replicated and added to the replacement deck. In a preferred embodiment, the selected particular symbols are doubled. For example, if the player selects A (Ace), then all of the Aces in the replacement deck are duplicated. In other words, if the replacement deck contained the Ace of Spades and the Ace of Hearts, then the enhanced replacement deck would contain two Aces of Spades and two Aces of Hearts. If the player selects Clubs, then all of the Clubs in the replacement deck are duplicated. In other words, if the replacement deck contained nine particular Clubs, then the enhanced replacement deck would contain eighteen Clubs (two of each said particular Clubs). In an alternate method, it may be possible to triple or quadruple the amount of the selected symbol in the replacement deck. Preferably, the player is informed by an onscreen display of the amount of cards to be added and the total of all ranks and suits in the final enhanced deck. The player then presses Draw to receive the replacement cards. If the player has declined the Stack the Deck Feature (if, for example, he has a pat hand such as a straight, flush, full house, or straight flush that he wants to keep and has held all five cards), he simply presses Draw to continue without choosing an individual symbol. Cards are randomly selected from the enhanced replacement deck, and populate the initial hand of held cards to complete the final 5-card hand. The final hand is analyzed for wins, and any wins are paid according to a predetermined paytable.

It should be appreciated that this gameplay may provide duplicate cards (for instance, two Jacks of Hearts) in the final hand. In that said case, the hand is analyzed, and the highest ranked hand wins. Just as a full house does not pay out for the pair and the 3-of-a-Kind, a hand of five Hearts including two Jacks of Hearts will only pay out for the higher ranking hand, the flush. This gameplay also provides for the possibility of achieving 5-of-a-Kind, which adds an extra expectation and greater excitement to the gameplay. For example, a hand of 2 of Clubs, 2 of Hearts, 2 of Spades, 2 of Diamonds and 2 of Diamonds would be a 5-of-a-Kind hand. The 5-of-a-Kind may or may not be the highest ranking hand, depending on the mathematical analysis and the corresponding predetermined paytable.

The Stack the Deck Feature also includes a special event when the player is dealt a 4-of-a-Kind hand. Since a dealt 4-of-a-Kind hand does not allow for replicating (duplicating or tripling or quadrupling) the rank of the 4-of-a-Kind (there would be no cards of that said rank in the replacement deck), a special event is offered to the player: a specific, random or pseudo-random amount (at least one card) of those cards matching the rank of the 4-of-a-Kind are added to the replacement deck. This can be accomplished by a mere display of the number of cards, or it may be achieved by providing an extra element such as a number wheel. The number wheel is displayed on the screen and may, for example, have four numbers on it: 1, 2, 3, and 4. The player spins the wheel by a touchscreen or physical machine button, and is afforded that amount of same-ranked cards to be added to the replacement deck. For example, if the player has been dealt four 7s and an Ace, and holds only the four 7s, then spins a 3 on the number wheel, three 7s (matching three of the dealt 7s) will be added to the replacement deck. The player is therefore provided the possibility of achieving a 5-of-a-Kind as the final hand.

In a second embodiment of the present invention, instead of doubling, tripling or quadrupling cards in the replacement deck that match the selected specific rank or suit, the player or processor may select one of the foresaid symbols and receive at least one card of that rank or suit. The at least one card may match a card in the replacement deck or the original deck. The amount of cards received may be a fixed predetermined amount, or it may be a random or pseudo-random amount. Preferably, the player is informed by an onscreen display of the amount of cards to be added and the total of all ranks and suits in the final enhanced deck. For instance, if the player has held two Queens, the other two Queens would be in the replacement deck. If the rules concerning the Stack the Deck Feature require a predetermined amount of three cards of the selected symbol to be added to the replacement deck, then three Queens (thus matching cards in the dealt hand and the replacement hand) will be added to the replacement deck. On the other hand, the number of Queens to be added may be random, and at least one Queen will be added.

It should be apparent that the present invention may allow for extra wagers of at least one credit, and the amount of the extra wager may determine the frequency of activating the special function. The activation of the special function may be random, occurring on an average of X amount of games, or the activation may be specific, occurring every X amount of games or on every game. The special function may be activated after the wager is recognized by the processor and before any cards are dealt, after the wager is recognized by the processor and while any cards are dealt, after the wager is recognized by the processor and after the initial hand is completely dealt, or after the wager is recognized by the processor and after none, one, some or all of the hold cards have been chosen.

Although the above description provides enhanced payouts for a single hand of video poker, it should be appreciated that multiple hands of video poker may be played simultaneously, with the gameplay of the present invention being afforded to all wagered hands.

Reference to the Figures will assist in further understanding of the practice of the present invention.

FIG. 1 illustrates a gaming machine that includes at least a cabinet 2 and monitor screen 4 capable of displaying a video gambling game 6. The video gambling game comprises at least a symbol game and touchscreen buttons or physical buttons 8 that enable a player to play the video wagering game. An additional video monitor screen 10 may be provided, upon which individual game symbols may be displayed. The gaming machine or apparatus preferably also includes speakers 12, and a value input/output device 14 that allows a player to insert value for game play or extract value of said game play. A separate device 16 is provided that preferably enables a player card or ticket to be inserted for the purpose of keeping track of player information, providing information of benefits or events, and the like. In rarer or older examples, a coin output device 18 may be provided. An electronic signaling device 20 may be apportioned on the top of the gaming machine to signal information of wins or needs to the appropriate people or employees.

Figure 2:
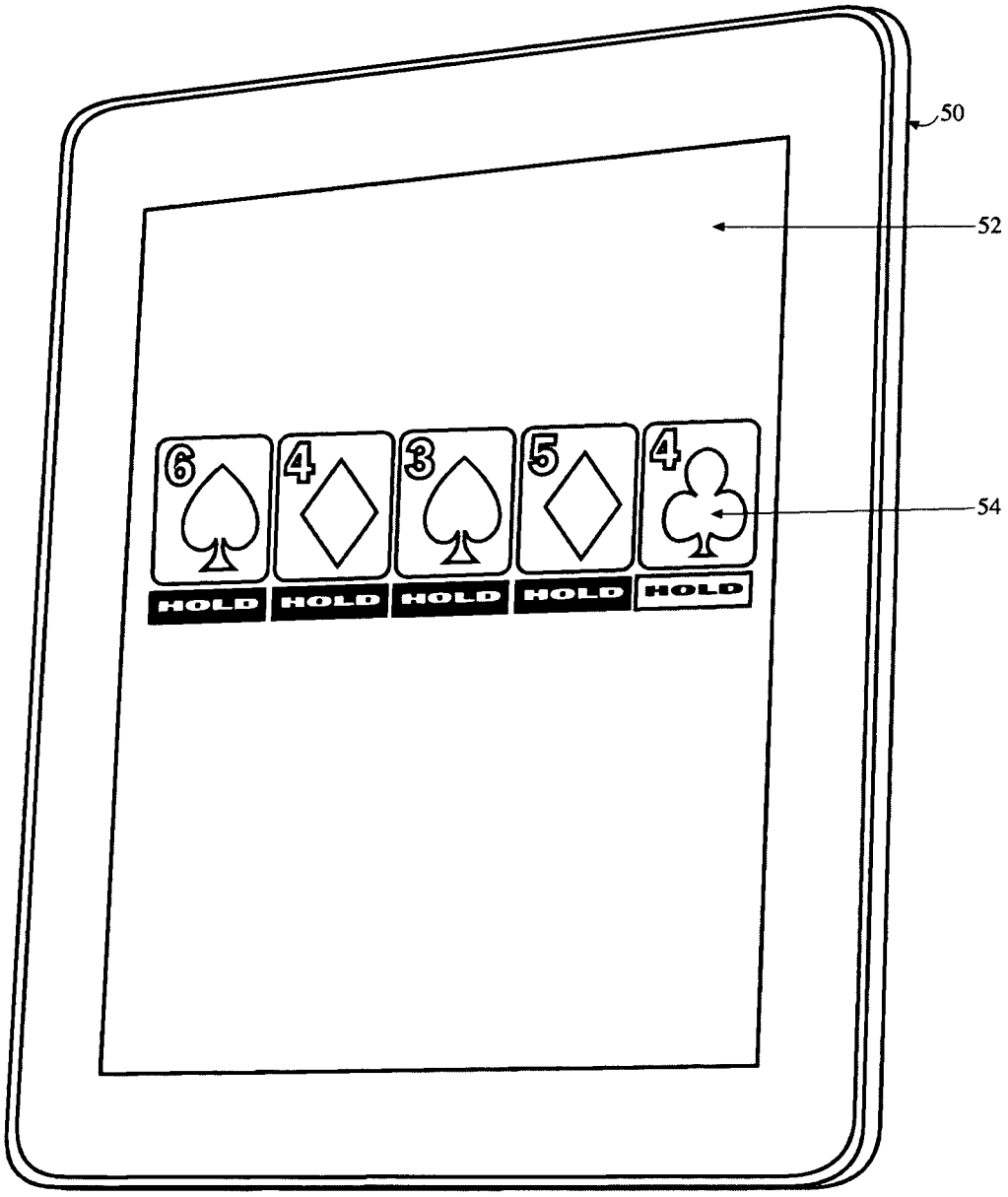
FIG. 2 shows an example of a second device capable of executing the present invention.

FIG. 2 illustrates an alternate device 50 capable of displaying and playing a video wagering game 54 on a screen monitor 52. The said devices may include at least a desktop computer, a laptop computer, an iPad®-like device, or an iPhone®-like device.

Figure 3A:
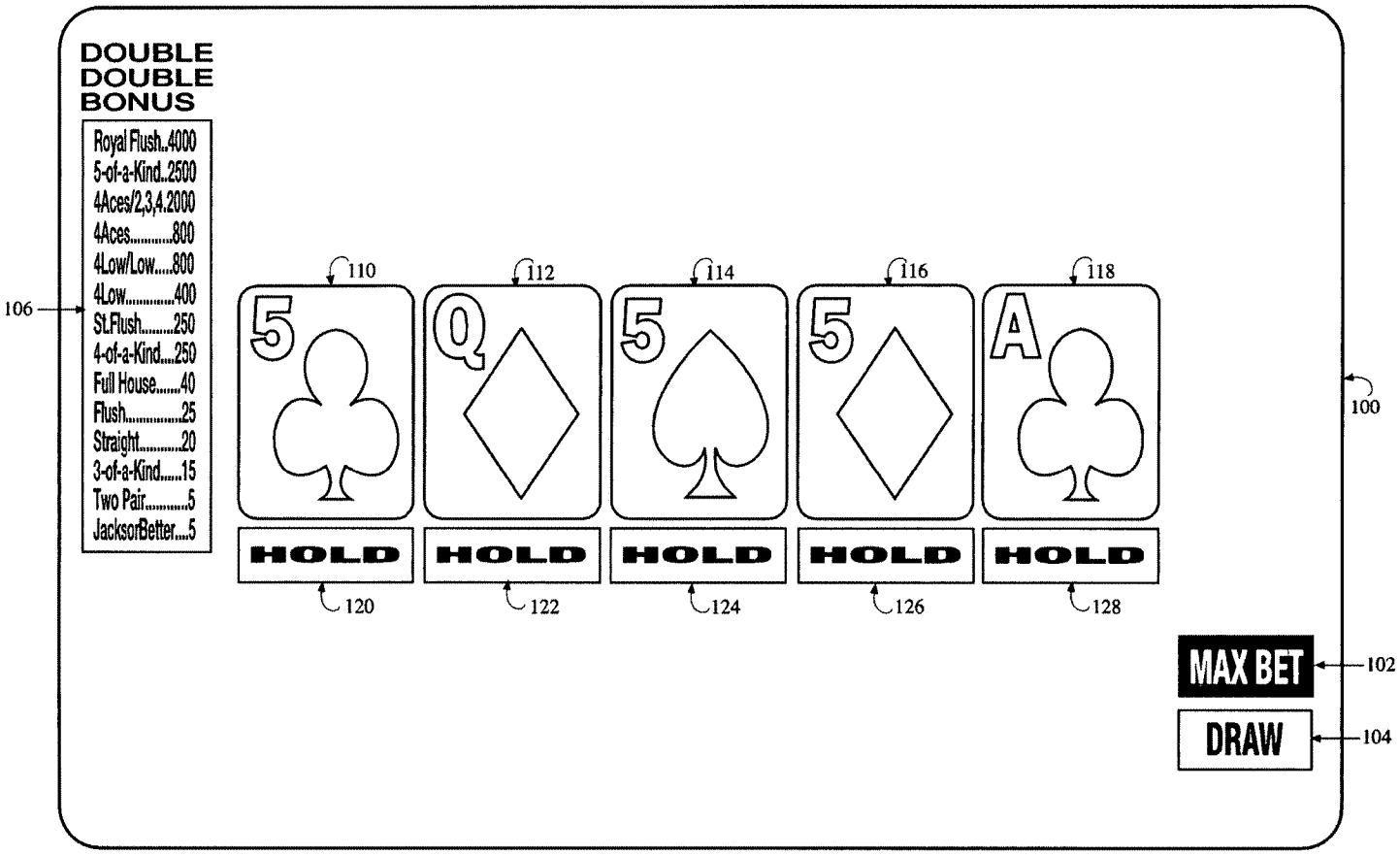
FIG. 3A shows an electronic screen utilizing the game technology described herein, and providing a first game of the present technology.

FIG. 3A illustrates an electronic screen 100 depicting the basic elements of a first game of the first embodiment of the present invention. In this embodiment, the max bet is comprised of a bet of six credits and includes a primary wager of five credits to play the game, and an additional one-credit wager to activate a special function. Also shown is a touchscreen button that enables the player to bet or wager by pressing the button 102 (activated buttons are shown highlighted in black). (It should be appreciated that any touchscreen buttons may in fact be physical buttons, keypad buttons, mouse, etc.) The initially dealt cards are shown, including an area for the first card the 5 of Clubs 110, an area for the second card the Queen of Diamonds 112, an area for the third card the 5 of Spades 114, an area for the fourth card the five of Diamonds 116, and an area for the fifth card the Ace of Clubs 118. Also shown are five HOLD buttons to facilitate the play of the present invention (120, 122, 124, 126, 128). A sample paytable 106 is also displayed.

Figure 3B:
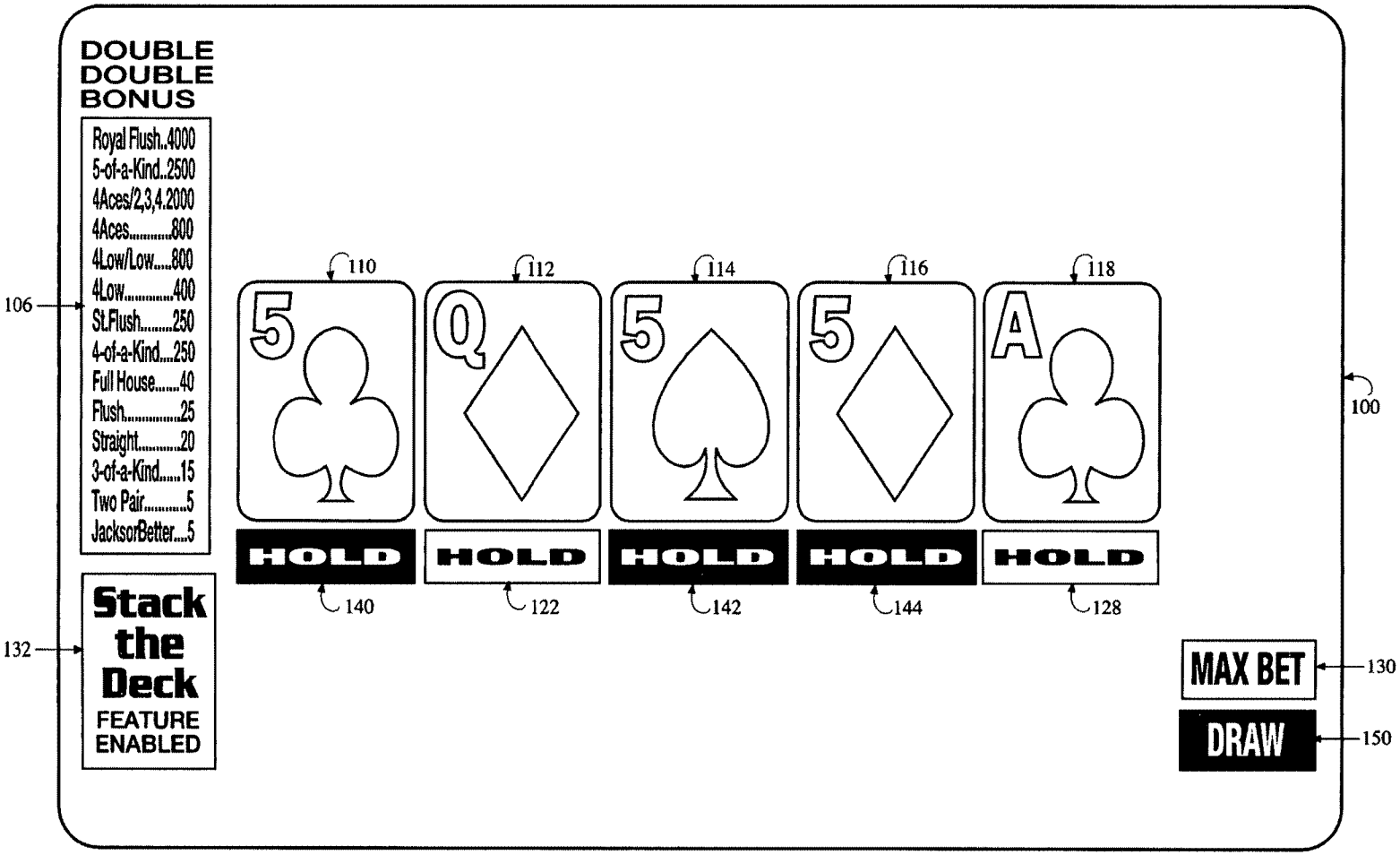
FIG. 3B shows the first game of the present technology at a later stage.

FIG. 3B refers to the elements in FIG. 3A, wherein the player has already made the max bet 130, and the special function called "Stack the Deck" 132 is shown being enabled for play during the wagered game. The player then selects to HOLD the three 5s (140, 142, 144) and presses DRAW 150 to continue.

Figure 3C:
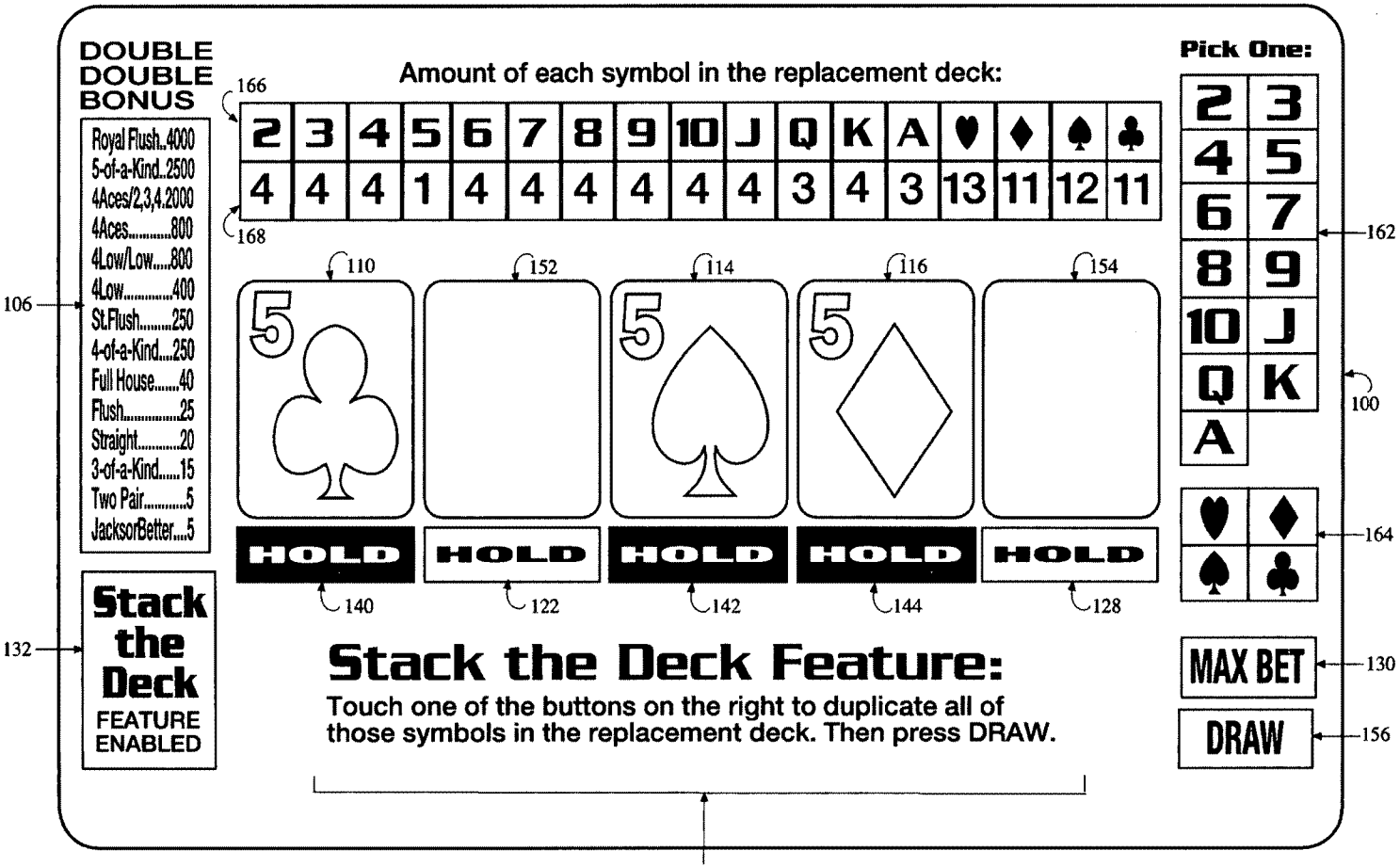
FIG. 3C shows the first game of the present technology at a later stage.

FIG. 3C refers to the elements in FIG. 3B with the two unheld cards (152, 154) being deleted. The unhighlighted DRAW button 156 is now off. The Stack the Deck Feature is randomly activated and explained 160. A symbol grid is then displayed, comprised of separate touchscreen buttons comprising the thirteen ranks 162 and the four suits 164 in the traditional 52-card deck. A separate amount grid is displayed, providing the symbols of the ranks and suits 166 and the amounts of each symbol in the replacement deck of 47 cards 168. Note that there is only one 5 in the replacement deck (the 5 of Hearts), and the amount of each suit has been diminished by the amount of that particular suit in the original 5-card hand.

Figure 3D:
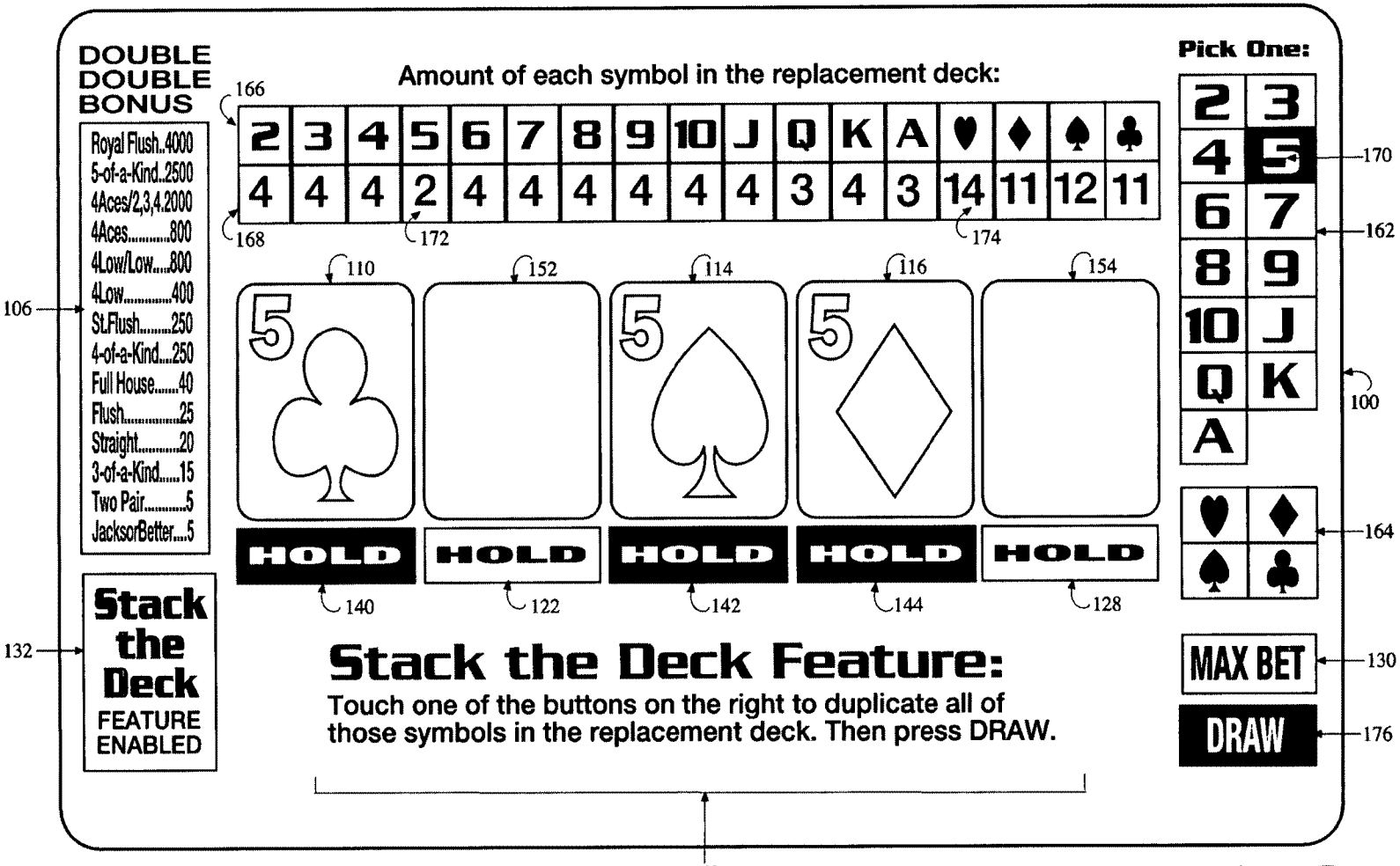
FIG. 3D shows the first game of the present technology at a later stage.

FIG. 3D refers to the elements in FIG. 3C, with the player electing to select the symbol "5" rank 170 to be duplicated in the replacement deck. That selection is now indicated in the amount grid as providing two 5s 172 (two 5s of Hearts). Because an additional Heart has been added, the total of Hearts in the replacement deck is now fourteen (174). The player then presses DRAW 176 to receive his replacement cards.

Figure 3E:
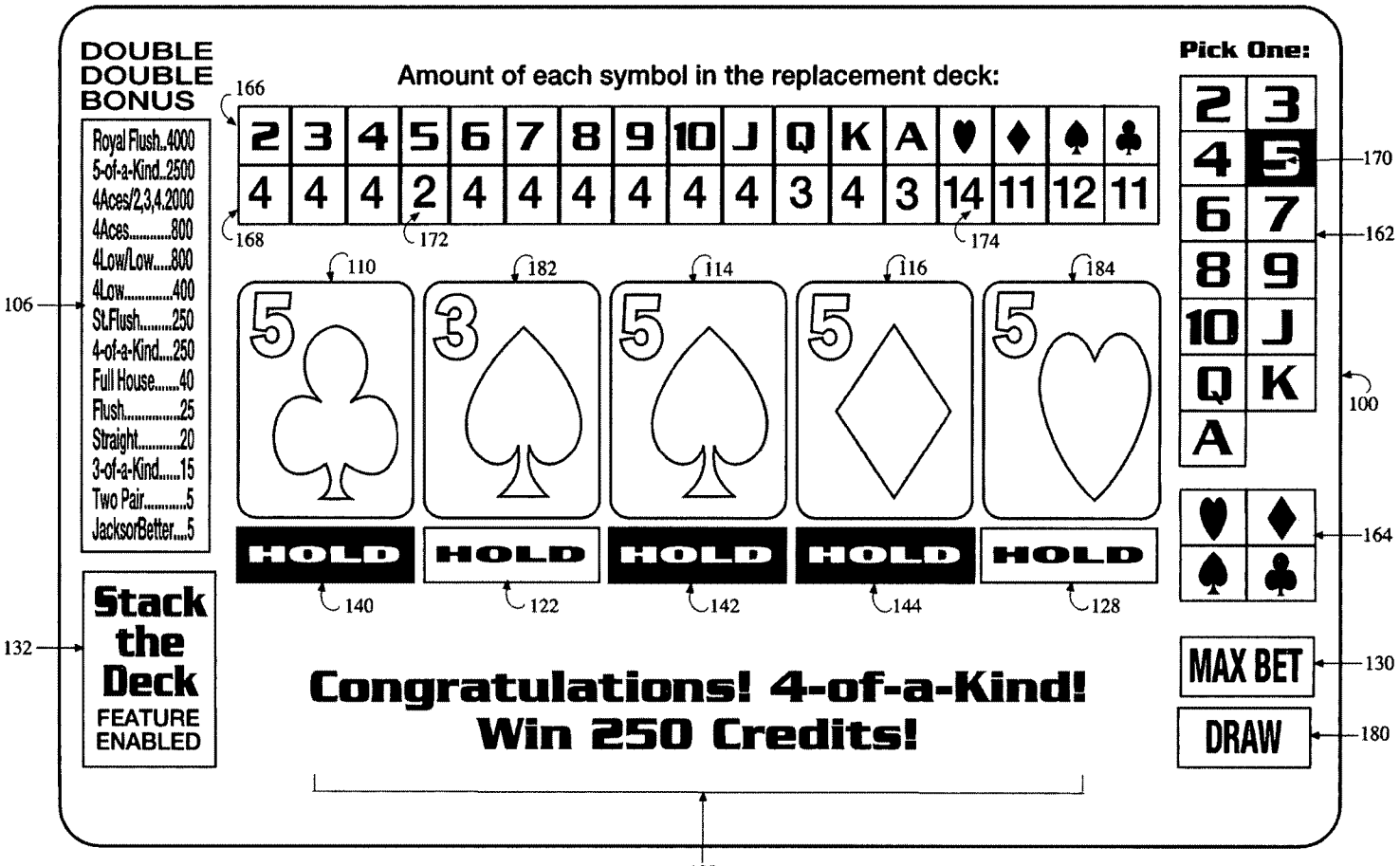
FIG. 3E shows the first game at a final resolution stage.

FIG. 3E refers to the elements in FIG. 3D with DRAW button being deactivated 180. The unheld second card is replaced by the 3 of Spades 182 and the unheld fifth card is replaced by one of the 5 of Hearts 184. The final hand is evaluated for wins, and the player is then notified that he has achieved a 4-of-a-Kind win of 250 credits 190, as shown in the paytable 106.

Figure 4A:
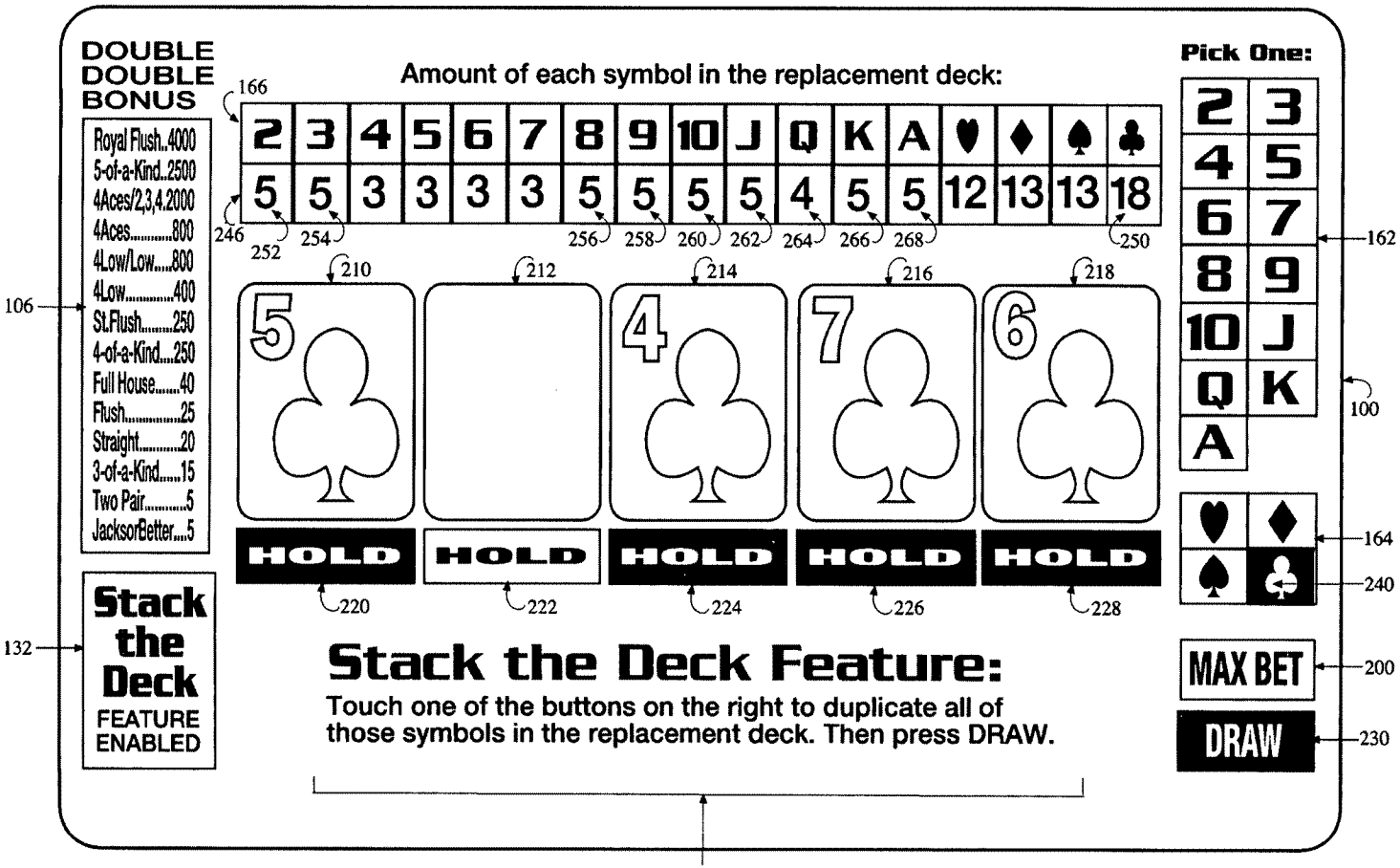
FIG. 4A shows a second game of the present technology.

FIG. 4A shows a second example of the first embodiment of the present invention with the player having made a MAX bet 200, and refers to the gameplay method as illustrated in FIGS. 3A through 3C with the paytable 106, the enabled Stack the Deck Feature 132, the informational description of the activated Stack the Deck Feature 160, the symbol grid comprised of separate touchscreen buttons comprising the thirteen ranks 162 and the four suits 164 in the traditional 52-card deck, and the amount grid providing the symbols of the ranks and suits 166 being displayed on the electronic monitor screen 100. In this said second example, the player has been dealt a 5-card face-up array of cards (the 5 of Clubs 210, the Queen of Hearts (not shown) 212, the 4 of Clubs 214, the 7 of Clubs 216, and the 6 of Clubs 218) and has chosen to HOLD (220, 224, 226, 228) the four Clubs. The card in the second position 212 from left to right (the Queen of Hearts) has not been HELD 222 and has been deleted as the player presses DRAW 230 to lock in his choice. Since the Stack the Deck Feature has become enabled 132 and the informational description of the activated Stack the Deck Feature 160 has been displayed, the player is given the opportunity to select one of the symbols in grids 162 or 164. The player touches the screen to select the symbol "Clubs" 240 to be doubled in the replacement deck, since the player has held four Clubs in the dealt hand, and is hoping for a better chance to obtain a final hand of a straight flush or a flush. Note that the player may have selected the symbol "3" or "8" if he wanted a better chance to obtain a final hand of a straight flush or a straight. The total of each symbol in the enhanced replacement deck is now shown 246. Note that there are now eighteen Clubs 250 in the enhanced replacement deck (the original nine Clubs in the replacement deck have now been doubled to eighteen), comprised of an additional 2 of Clubs 252, an additional 3 of Clubs 254, an additional 8 of Clubs 256, an additional 9 of Clubs 258, an additional 10 of Clubs 260, an additional Jack of Clubs 262, an additional Queen of Clubs 264, an additional King of Clubs 266, and an additional Ace of Clubs 268.

Figure 4B:
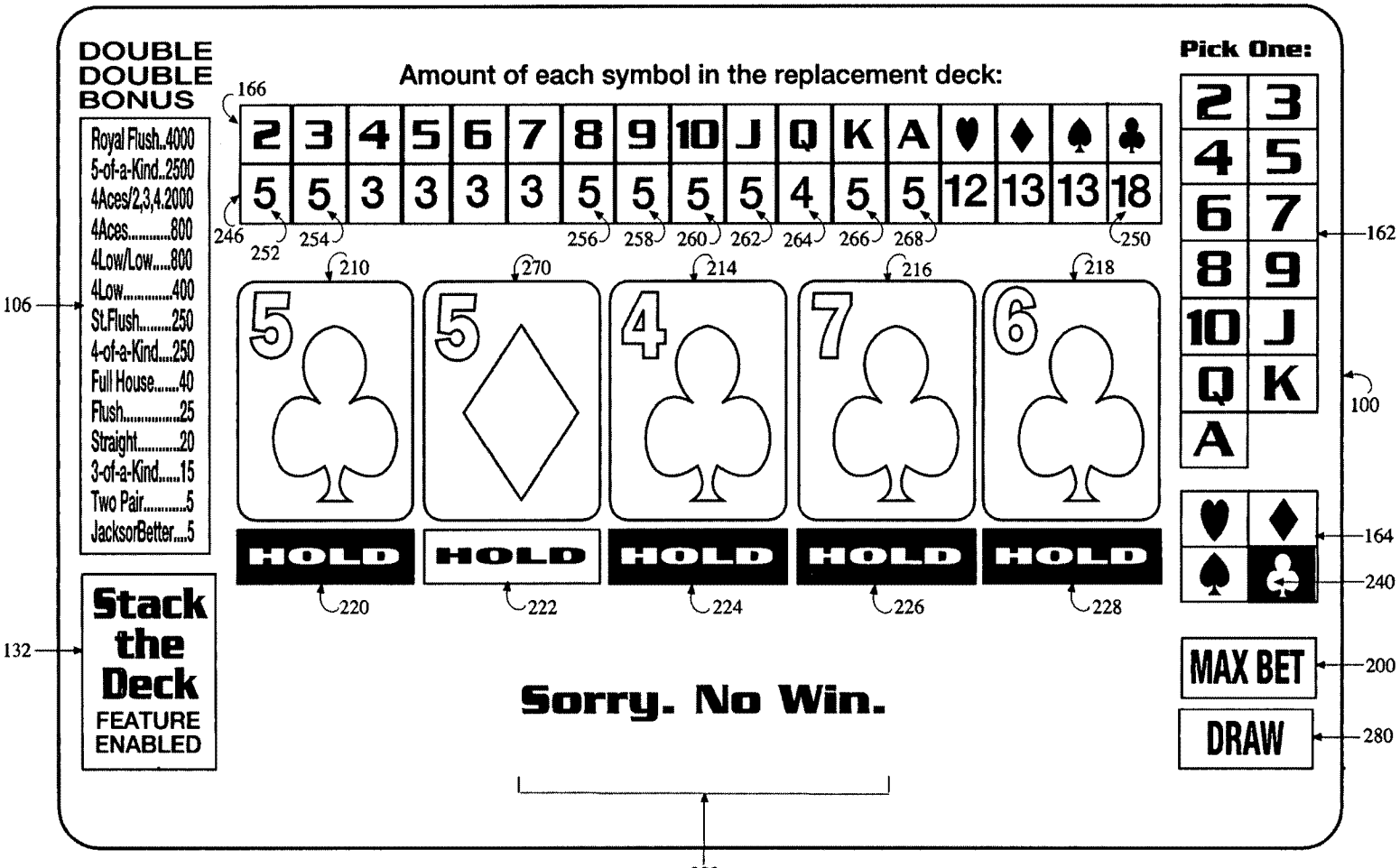
FIG. 4B shows the second game at a final resolution stage.

FIG. 4B refers to the elements in FIG. 4A with replacement card being the 5 of Diamonds 270. The unhighlighted DRAW button 280 is now off. The final hand does not contain a winning combination, and is therefore displayed as a "No Win" 290.

Figure 5A:
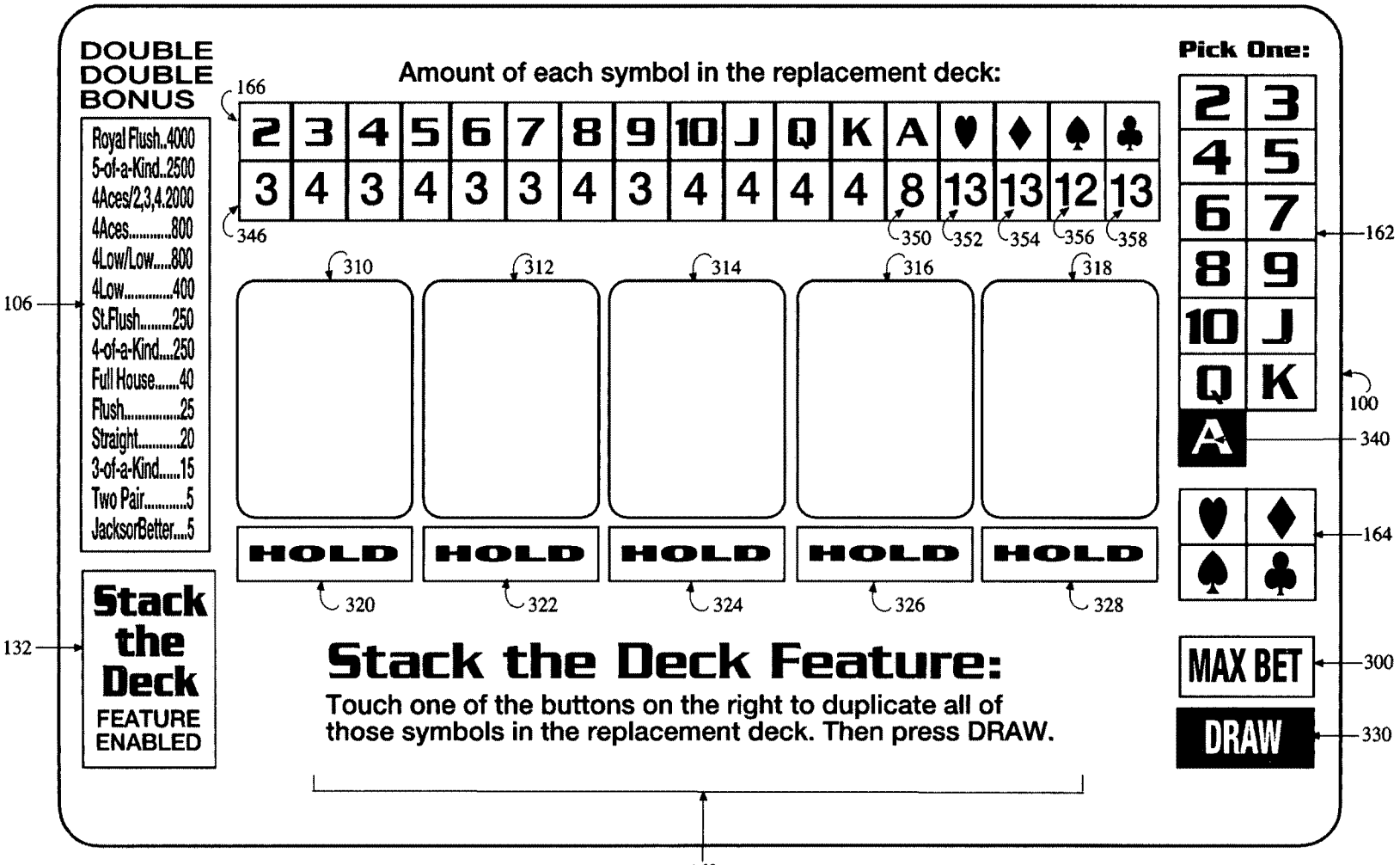
FIG. 5A shows a third game of the present technology.

FIG. 5A shows a third example of the first embodiment of the present invention with the player having made a MAX bet 300, and refers to the gameplay method as illustrated in FIGS. 3A through 3C with the paytable 106, the enabled Stack the Deck Feature 132, the informational description of the Stack the Deck Feature 160, the symbol grid comprised of separate touchscreen buttons comprising the thirteen ranks 162 and the four suits 164 in the traditional 52-card deck, and the amount grid providing the symbols of the ranks and suits 166 being displayed on the electronic monitor screen 100. In this said third example, the player has been dealt a 5-card face-up array of cards (a 2 of Hearts, a 4 of Diamonds, a 6 of Spades, a 7 of Spades, and a 9 of Clubs—not shown) and has chosen to not HOLD (320, 322, 324, 326, 328) any of the dealt cards. All five dealt cards are deleted (310, 312, 314, 316, 318) as the player presses DRAW 330 to lock in his choice. Since the Stack the Deck Feature has become enabled 132 and the informational description of the activated Stack the Deck Feature 160 has been displayed, the player is given the opportunity to select one of the symbols in grids 162 or 164. The player touches the screen to select the symbol "Ace" 340 to be doubled in the replacement deck, since the player has not held any cards in the dealt hand, and is hoping for a better chance to obtain a final hand of four or five Aces, as those hands provide premium pays. The total of each symbol in the enhanced replacement deck is now shown 346. Note that there are now eight Aces 350 in the enhanced replacement deck (the original four Aces in the replacement deck have now been doubled to eight), the additional four Aces being comprised of an additional Heart 352, an additional Diamond 354, an additional Spade 356, and an additional Club 358.

Figure 5B:
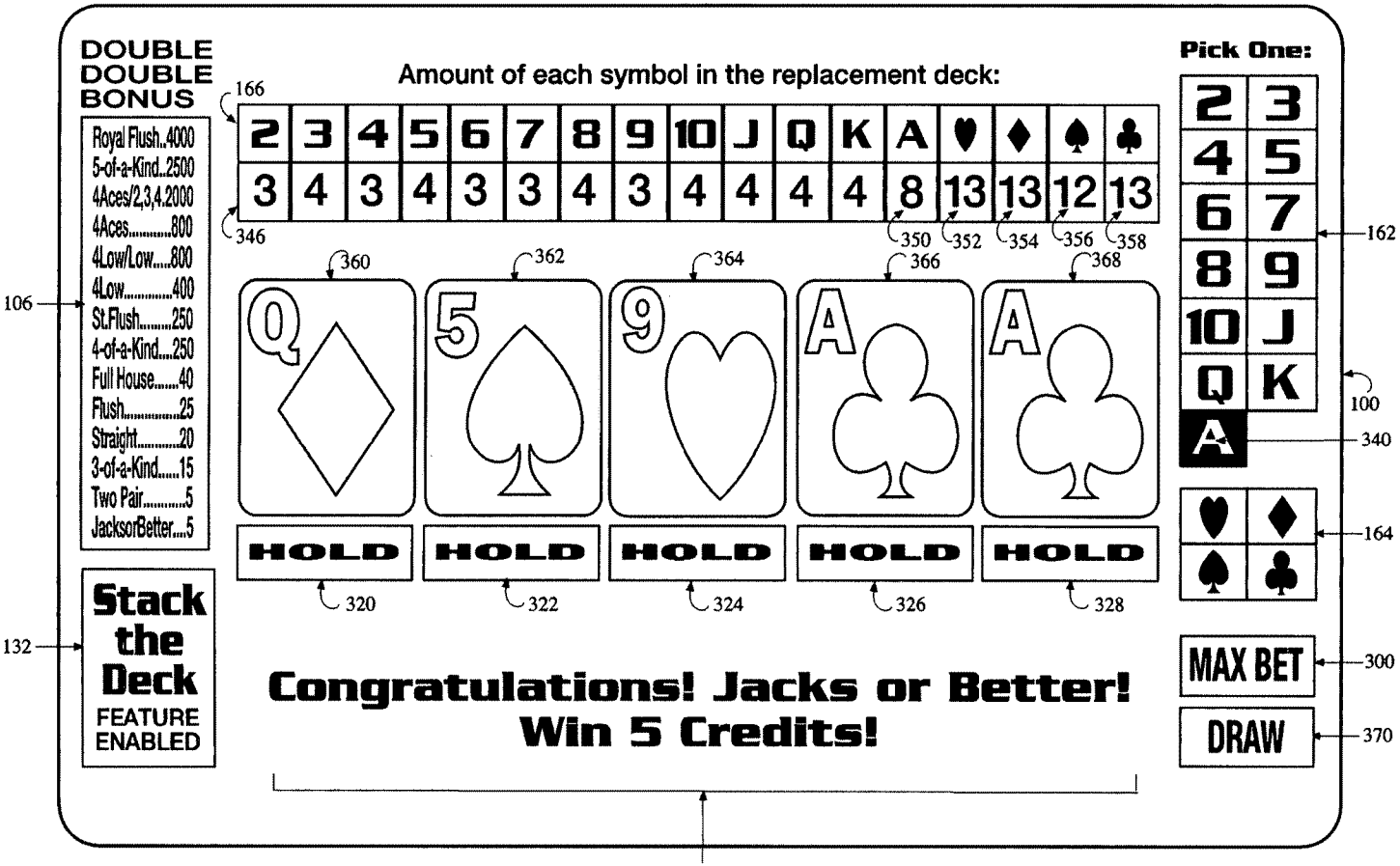
FIG. 5B shows the third game at a final resolution stage.

FIG. 5B refers to the elements in FIG. 5A with replacement cards being the Queen of Diamonds 360, the 5 of Spades 362, the 9 of Hearts 364, the Ace of Clubs 366, and the other Ace of Clubs 368. The unhighlighted DRAW button 370 is now off. The final hand contains a winning combination of Jacks or Better, and is therefore displayed as a "Win 5 Credits" 380.

Figure 6A:
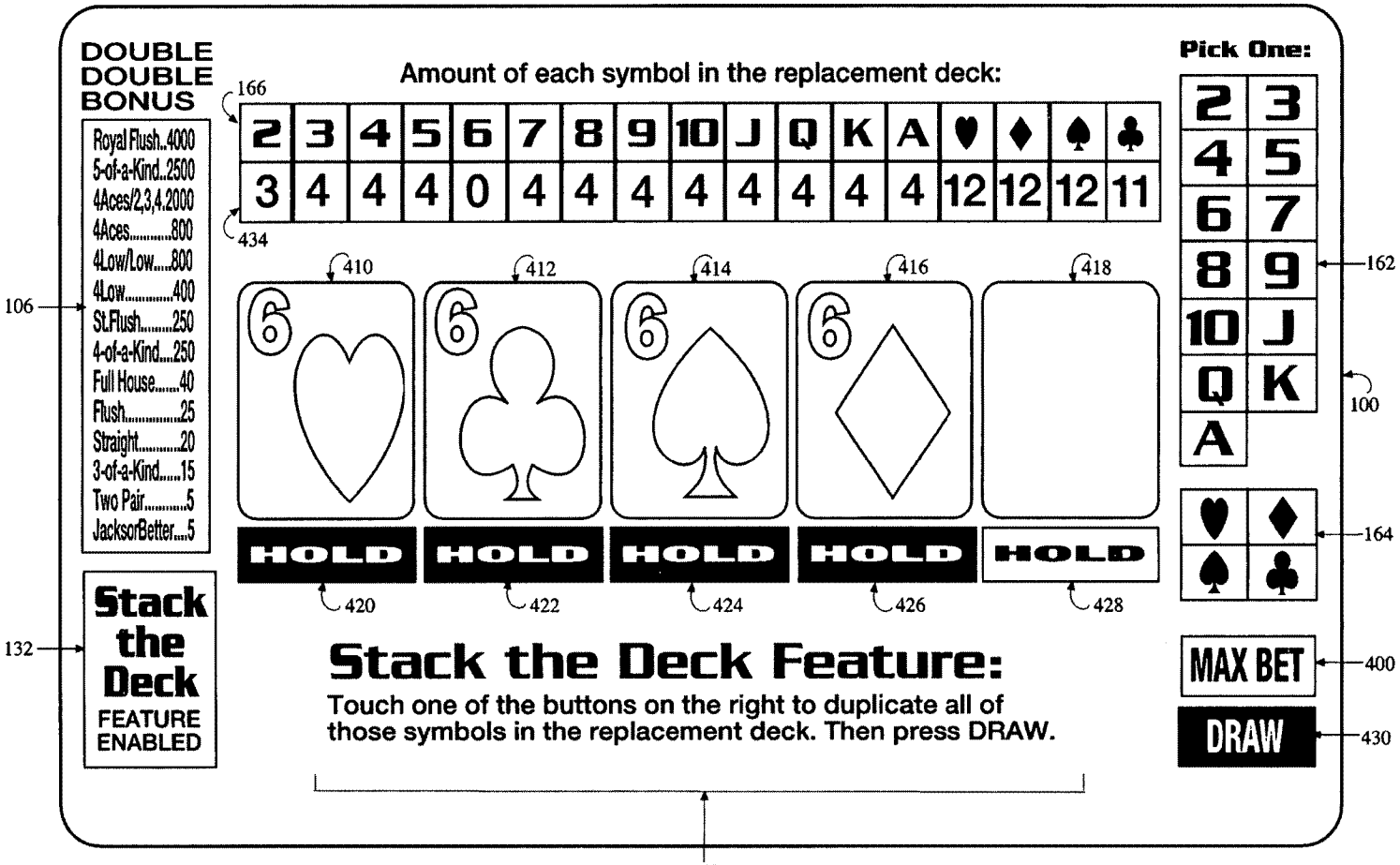
FIG. 6A shows an electronic screen utilizing the game technology described herein, and providing a fourth game of the present technology.

FIG. 6A shows a fourth example of the first embodiment of the present invention with the player having made a MAX bet 400, and refers to the gameplay method as illustrated in FIGS. 3A through 3C with the paytable 106, the enabled Stack the Deck Feature 132, the informational description of the activated Stack the Deck Feature 160, the symbol grid comprised of separate touchscreen buttons comprising the thirteen ranks 162 and the four suits 164 in the traditional 52-card deck, and the amount grid providing the symbols of the ranks and suits 166 being displayed on the electronic monitor screen 100. In this said fourth example, the player has been dealt a 5-card face-up array of cards (the 6 of Hearts 410, the 6 of Clubs 412, the 6 of Spades 414, the 6 of Diamonds 416, and the 2 of Clubs [not shown] 418), and has chosen to HOLD (420, 422, 424, 426) the four 6s. The amount of each symbol in the replacement deck of 47 cards 434 is shown. The card in the fifth position 418 from left to right (the 2 of Clubs) has not been HELD 428 and has been deleted as the player presses DRAW 430 to lock in his choice. Since the Stack the Deck Feature has become enabled 132, and the Stack the Deck Feature has become activated and the informational description 160 has been displayed, the player is given the opportunity to select one of the symbols in grids 162 or 164.

Figure 6B:
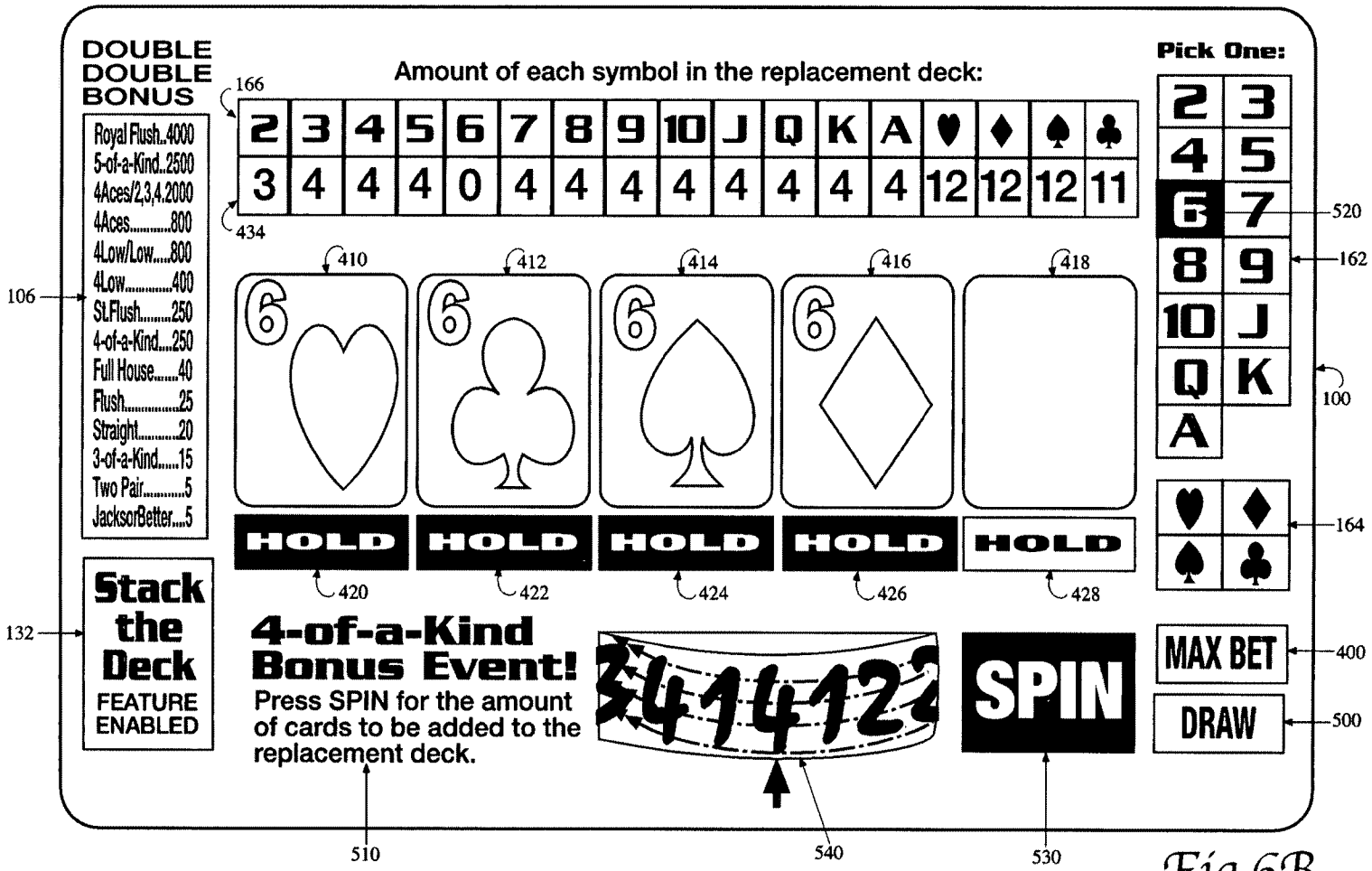
FIG. 6B shows the fourth game of the present technology at a later stage.

FIG. 6B illustrates a special gameplay provided when the player has been dealt a 4-of-a-Kind, and HOLDS all four of said cards (see FIG. 6A). As soon as the player locks in this choice (see FIG. 6A), the DRAW button turns to OFF 500. The screen then displays the "4-of-a-Kind Bonus Event" which instructs the player to press SPIN for the amount of cards to be added to the replacement deck 510. The processor automatically chooses the 6 520 in the rank grid 162, since that rank will be the most advantageous for the player, who may be able to achieve a 5-of-a-Kind. The player presses the touchscreen SPIN button 530, which starts the Number Wheel spinning 540.

Figure 6C:
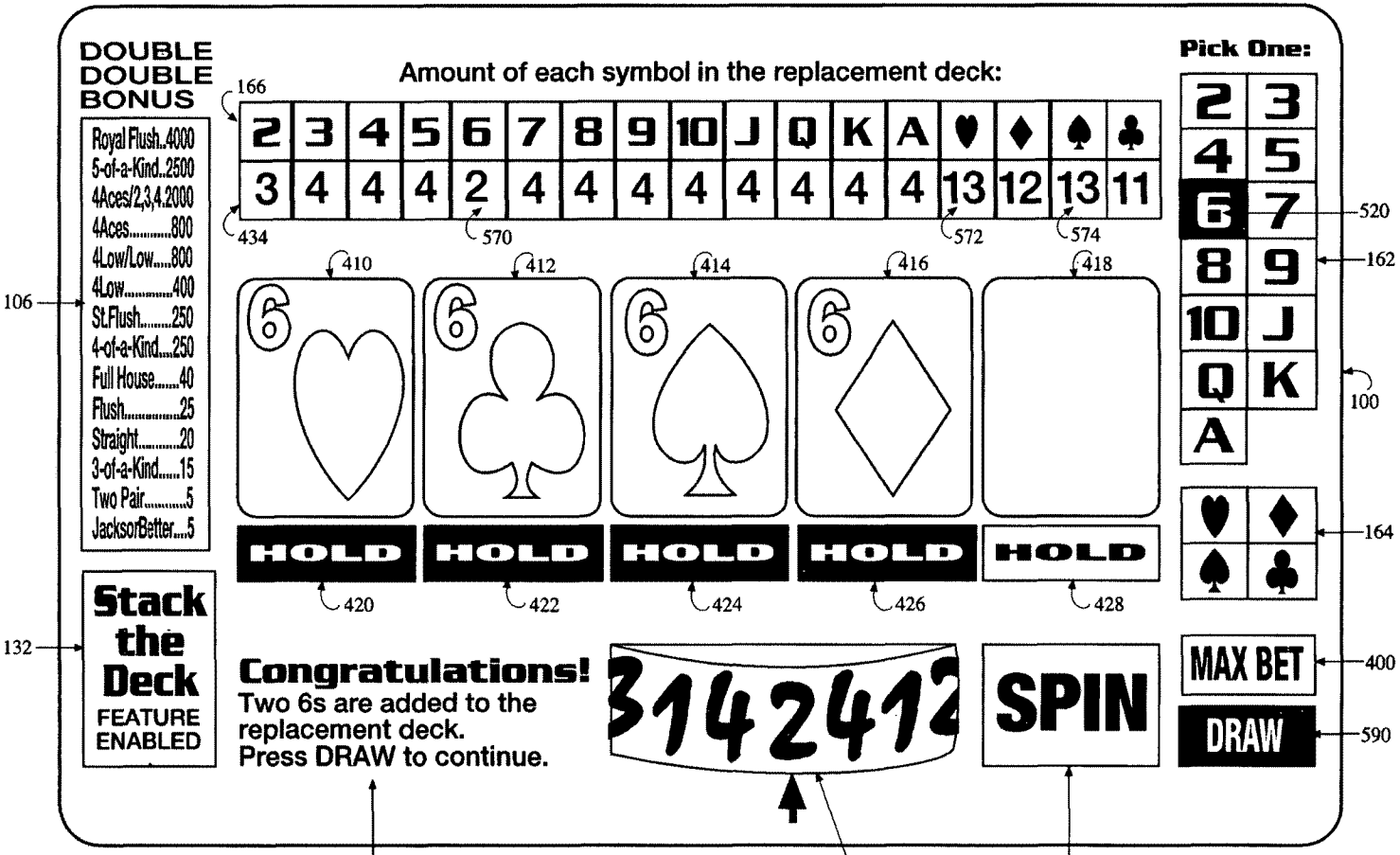
FIG. 6C shows the fourth game of the present technology at a later stage.

FIG. 6C refers to the elements in 6B, with the SPIN button being OFF 550, and the Number Wheel stopping on the number 2 560. The player will now receive two additional 6s (matching two of the 6s in the dealt hand) in the replacement deck. The total of each symbol in the enhanced replacement deck is now shown 434. Note that there are now two 6s 570 in the enhanced replacement deck (the original zero 6s in the replacement deck have now been increased to two), comprised of an additional 6 of Hearts 572 and an additional 6 of Spades 574. The player is informed of the additional cards added 580. The player presses DRAW 590 to continue.

Figure 6D:
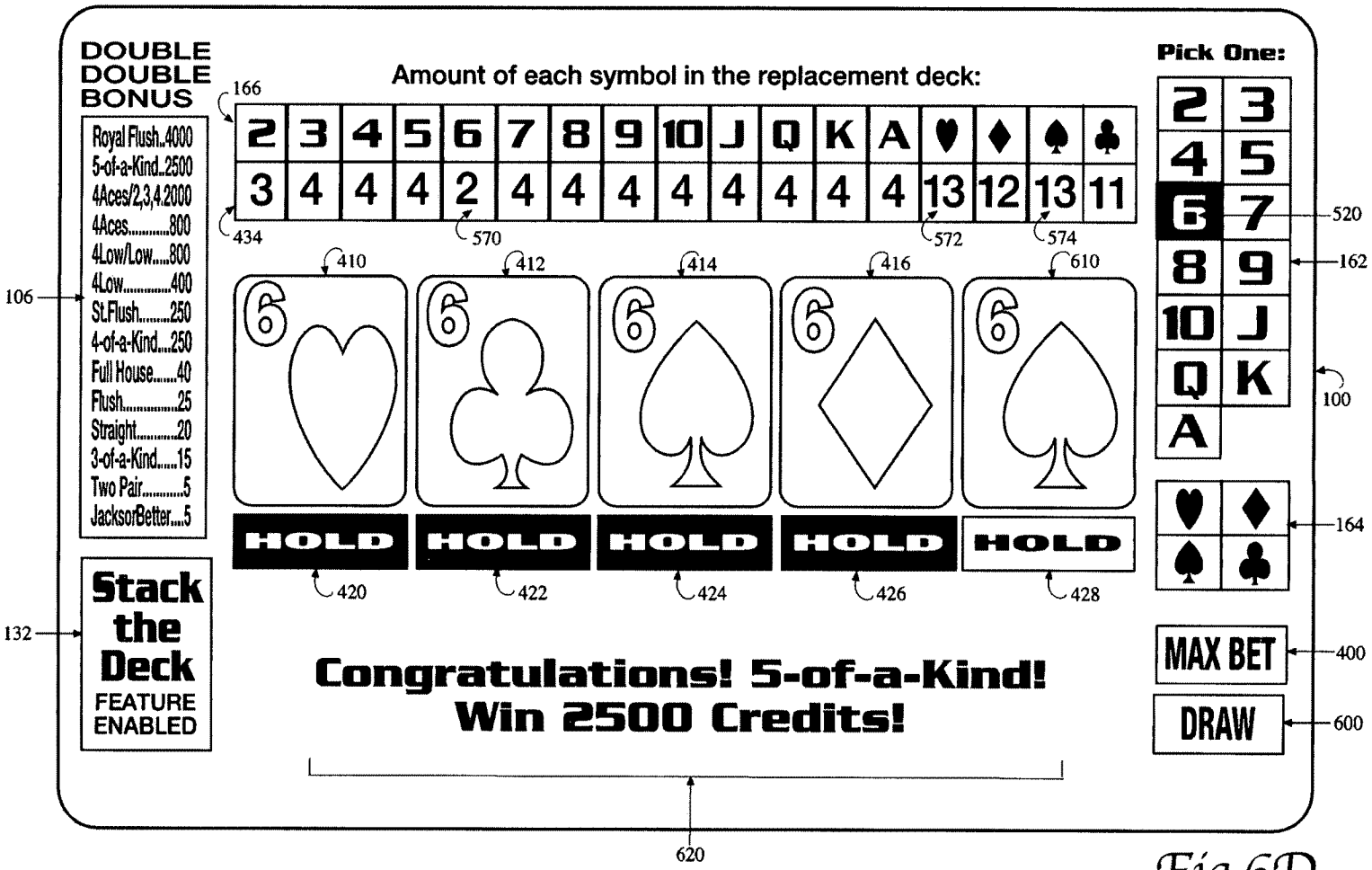
FIG. 6D shows the fourth game at a final resolution stage.

FIG. 6D refers to the elements in FIG. 6C with replacement card being the 6 of Spades 610. The unhighlighted DRAW button 600 is now off. The final hand contains a winning combination of 5-of-a-Kind, and is therefore displayed as a "Win 2500 Credits" 620.

Figure 7A:
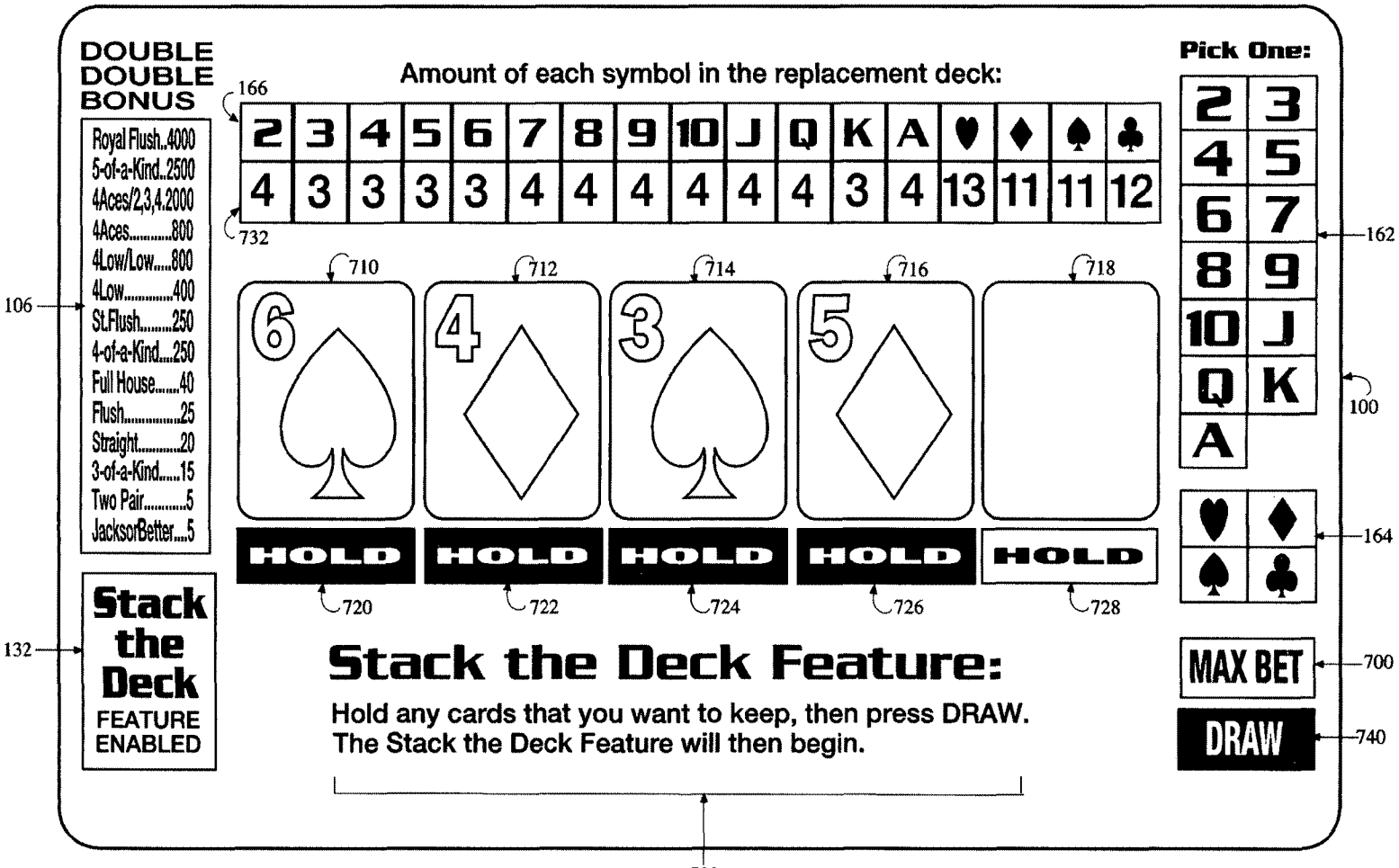
FIG. 7A shows an electronic screen utilizing a second embodiment of the game technology described herein, and providing a first game thereof.

FIG. 7A shows an example of the second embodiment of the present invention with the player having made a MAX bet 700, and refers to the gameplay method as illustrated in FIGS. 3A through 3C with the paytable 106, the enabled Stack the Deck Feature 132, the symbol grid comprised of separate touchscreen buttons comprising the thirteen ranks 162 and the four suits 164 in the traditional 52-card deck, and the amount grid providing the symbols of the ranks and suits 166 being displayed on the electronic monitor screen 100. In this example, a different informational description of the Stack the Deck Feature 702 is provided. The player has been dealt a 5-card face-up array of cards (the 6 of Spades 710, the 4 of Diamonds 712, the 3 of Spades 714, the 5 of Diamonds 716, and the King of Clubs [not shown] 718), and has chosen to HOLD (720, 722, 724, 726) the four cards to a straight. The amount of each symbol in the replacement deck of 47 cards 732 is shown. The card in the fifth position 718 from left to right (the King of Clubs) has not been HELD 728 and has been deleted as the player presses DRAW 740 to lock in his choice. The informational description 702 informs the player that the Stack the Deck Feature will now begin.

Figure 7B:
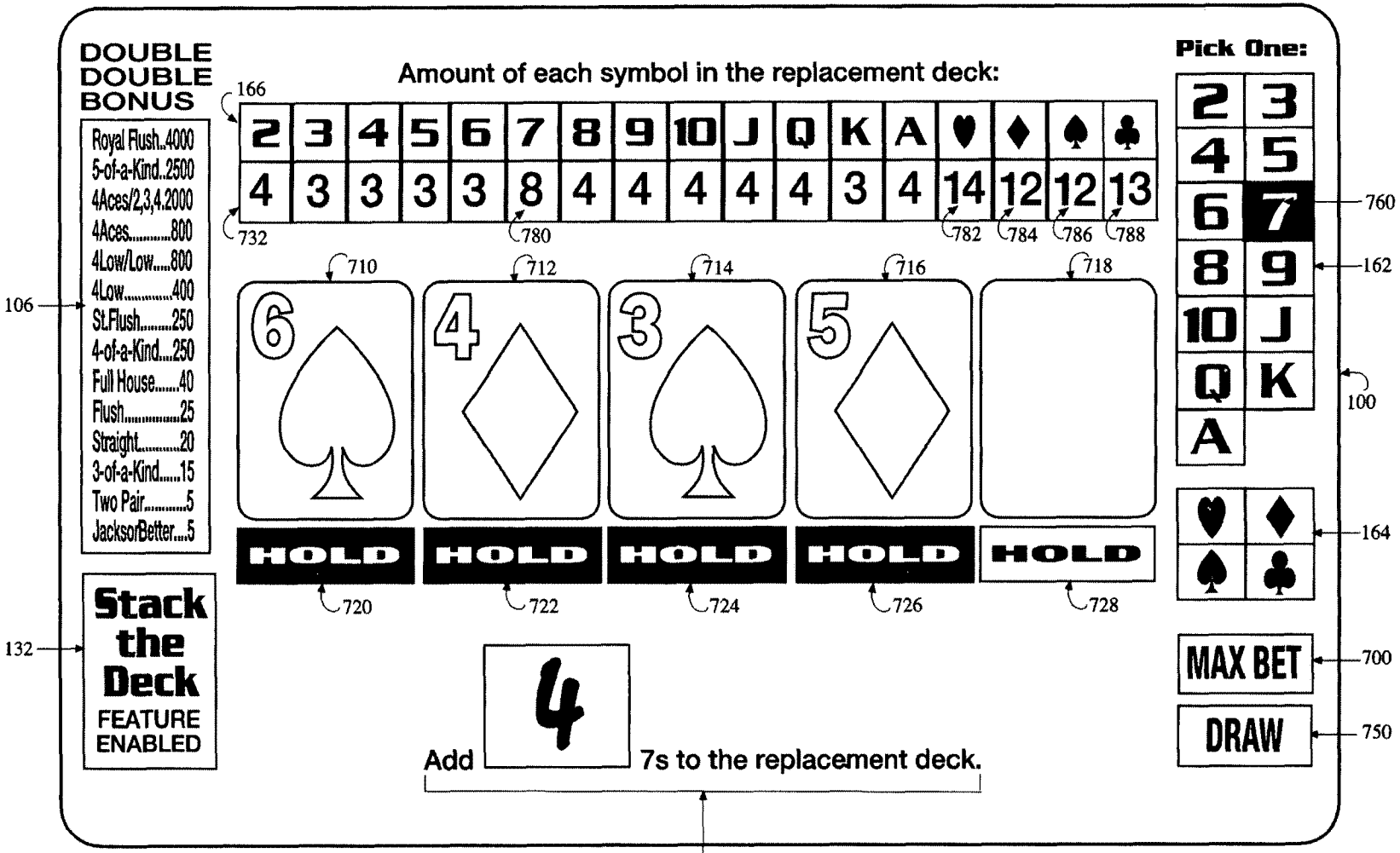
FIG. 7B shows the first game of the second embodiment of the game technology at a later stage.

FIG. 7B refers to the elements in FIG. 7A, with the DRAW button shown as OFF 750, and the player being given the opportunity to select one of the symbols in grids 162 or 164 and selecting the rank of 7 760 as the symbol to be enhanced. (The player is trying for a final hand of a straight, and could have selected the rank 2 instead.) A display providing an amount of additional cards to be added to the replacement deck 770 is then shown. It should be noted that the amount of additional cards to be added may be a predetermined amount or a random or pseudo-random amount. This example shows the player receiving four extra 7s, as is shown in the symbol amount grid wherein there are now eight 7s 780 in the enhanced replacement deck, comprised of an additional Heart 782, an additional Diamond 784, an additional Spade 786, and an additional Club 788.

Figure 7C:
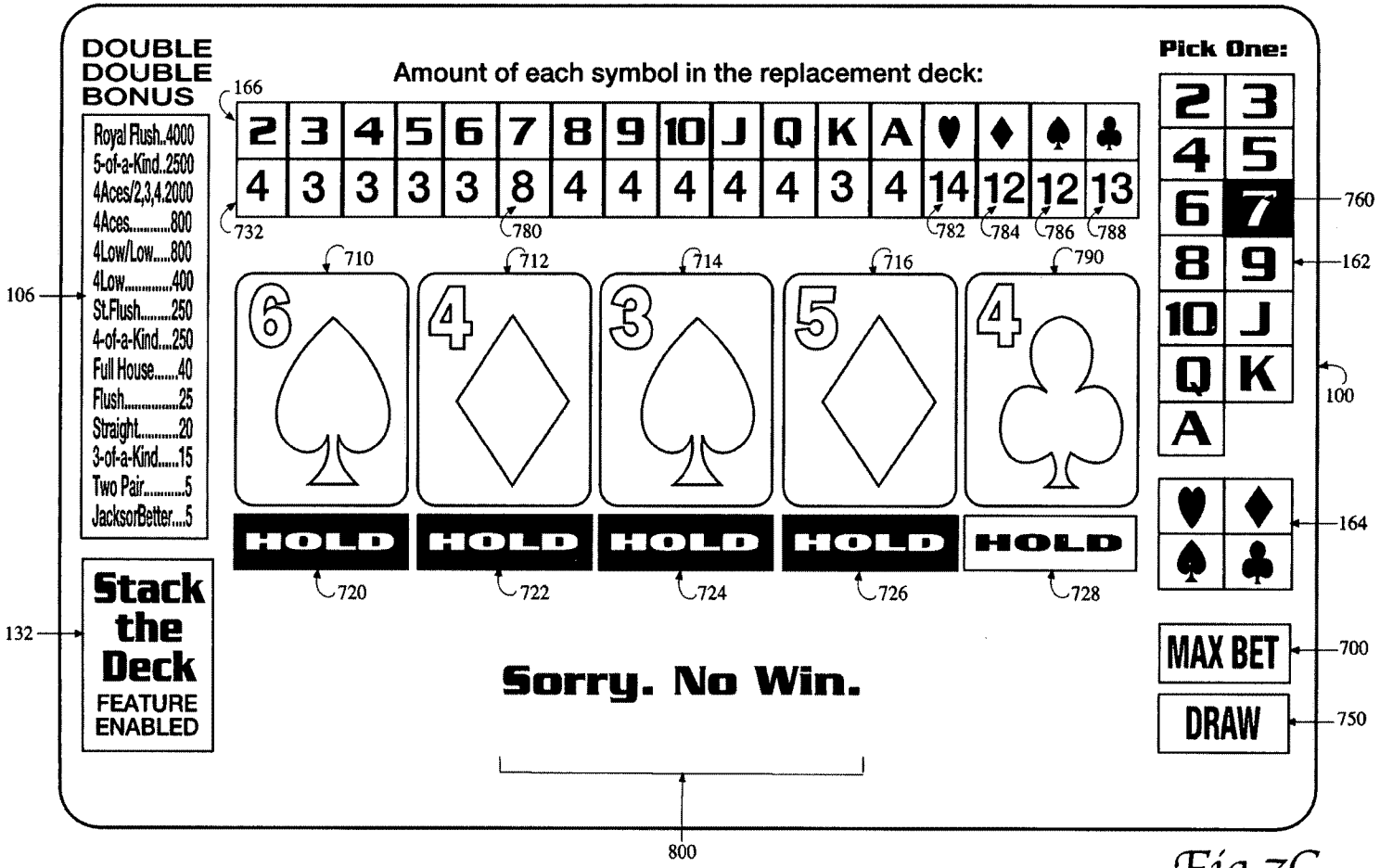
FIG. 7C shows the first game of the second embodiment of the game technology at a final resolution stage.

FIG. 7C refers to the elements in FIG. 7B with replacement card being the 4 of Clubs 790. The final hand does not contain a winning combination, and is therefore displayed as a "No Win" 800.

Although specific examples and specific paytables have been provided in this discussion, these specifics are intended to be only support for the generic concepts of the invention and are not intended to be absolute limits in the scope of the technology discussed.

What is claimed:

1. A video poker machine comprising: a housing; at least one display device; at least one processor; at least one physical input device configured to detect a physical item associated with a monetary amount that establishes a credit balance; at least an electronic input device; and at least one memory device which stores a plurality of instructions which, when executed by the at least one processor, cause the at least one processor to operate with the at least one display device and the at least one electronic input device to:

a) establish a predetermined paytable associated with a final five-card poker hand ranking;
b) establish an initial deck of playing cards to be used in the play of the poker game;
c) enable the player, using at least one input device, to make at least one wager on a five card poker hand;
d) after the player makes the at least one wager, provide a special function indicator to determine if a special function will be activated during the play of the poker hand;
e) display to the player five cards face up representing an initial poker hand;
f) establish a first depleted deck of playing cards as a replacement deck representing the initial deck of playing cards less the five cards of the initial poker hand;
g) enable the player, using at least one input device, to select none, one, a plurality or all of the face up cards from the initial poker hand as cards to be held;
h) discard from the initial poker hand each card that was not held;
i) if the special function has been activated, provide a symbol grid comprised of the individual ranks and suits in the initial deck;
j) enable each of the individual symbols to be activated by at least one input device;
k) select one of the individual symbols to be activated;
l) replicate all of the cards in the replacement deck that match the selected activated symbol;
m) add the replicated card(s) to the replacement deck;
n) randomly provide replacement cards to complete the final five-card hand;
o) determine the poker hand ranking of the final poker hand; and
p) make an award based on the paytable to the player if the final poker hand is a winning hand according to the paytable.

2. The video poker machine of claim 1 wherein the special function may be activated at any specific time during the wagered game, specifically either before the deal of the initial hand, during the deal of the initial hand, after the deal of the initial hand, after the choice to hold none, one, some, or all of the dealt cards or after the player has locked in his choice.

3. The video poker machine of claim 2 wherein the special function may be activated randomly, pseudo-randomly, or on every wagered hand according to a math model.

4. The video poker machine of claim 2 wherein the special function may be activated according to a predetermined trigger event.

5. The video poker machine of claim 2 wherein the special function may be activated according to the amount of the wager.

6. The video poker machine of claim 1 wherein the selection of one of the individual symbols to be activated is performed by the player using an input device.

7. The video poker machine of claim 1 wherein the selection of one of the individual symbols to be activated is performed by the processor using a random or an optimum expected value function.

8. The video poker machine of claim 1 wherein replicating all of the cards in the replacement deck that match the selected activated symbol either doubles, triples or quadruples all of those said cards in the replacement deck.

9. The video poker machine of claim 1 wherein if the initial five-card dealt hand contains a Four-of-a-Kind, the player is provided a special event wherein the player is afforded at least one card that matches the rank of the Four-of-a-Kind to be added to the replacement deck.

10. A video poker machine comprising: a housing; at least one display device; at least one processor; at least one physical input device configured to detect a physical item associated with a monetary amount that establishes a credit balance; at least an electronic input device; and at least one memory device which stores a plurality of instructions which, when executed by the at least one processor, cause the at least one processor to operate with the at least one display device and the at least one electronic input device to:

a) establish a predetermined paytable associated with a final five-card poker hand ranking;
b) establish an initial deck of playing cards to be used in the play of the poker game;
c) enable the player, using at least one input device, to make at least one wager on a five card poker hand;
d) after the player makes the at least one wager, provide a special function indicator to determine if a special function will be activated during the play of the poker hand;
e) display to the player five cards face up representing an initial poker hand;
f) establish a first depleted deck of playing cards representing the initial deck of playing cards less the five cards of the initial poker hand;
g) enable the player, using at least one input device, to select none, one, some or all of the face up cards from the initial poker hand as cards to be held;
h) discard from the initial poker hand each card that was not held;
i) if the special function has been activated, provide a symbol grid comprised of the individual ranks and suits in the initial deck;
j) enable each of the individual symbols to be activated by at least one input device;
k) select one of the individual symbols to be activated;
l) provide at least one of the selected symbols that match the same said symbol in either the replacement deck or initially dealt cards to be added to the replacement deck;
m) randomly provide replacement cards to complete the final five-card hand;
n) determine the poker hand ranking of the final poker hand; and
o) make an award based on the paytable to the player if the final poker hand is a winning hand according to the paytable.

11. The video poker machine of claim 10 wherein the special function may be activated at any specific time during the wagered game, specifically either before the deal of the initial hand, during the deal of the initial hand, after the deal of the initial hand, after the choice to hold none, one, some or all of the dealt cards or after the player has locked in his choice.

12. The video poker machine of claim 11 wherein the special function may be activated randomly, pseudo-randomly or on every wagered according to a math model.

13. The video poker machine of claim 11 wherein the special function may be activated according to a predetermined trigger event.

14. The video poker machine of claim 11 wherein the special function may be activated according to the amount of the wager.

15. The video poker machine of claim 10 wherein the selection of one of the individual symbols to be activated is performed by the player using an input device.

16. The video poker machine of claim 10 wherein the selection of one of the individual symbols to be activated is performed by the processor using a random or an optimum expected value function.

* * * * *